US008436554B2

(12) United States Patent
Zhao et al.

(10) Patent No.: US 8,436,554 B2
(45) Date of Patent: May 7, 2013

(54) LED SOLAR ILLUMINATOR

(75) Inventors: Guoheng Zhao, Milpitas, CA (US); Ady Levy, Sunnyvale, CA (US); Alex Salnik, San Jose, CA (US); Mehdi Vaez-Iravani, Los Gatos, CA (US); Lena Nicolaides, Castro Valley, CA (US); Samuel S. H. Ngai, San Francisco, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 288 days.

(21) Appl. No.: 13/081,734

(22) Filed: Apr. 7, 2011

(65) Prior Publication Data

US 2012/0256559 A1 Oct. 11, 2012

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/294; 315/291; 315/295; 315/299

(58) Field of Classification Search ..... None
See application file for complete search history.

(56) References Cited

U.S. PATENT DOCUMENTS

| | | | |
|---|---|---|---|
| 5,539,485 | A | 7/1996 | White |
| 5,761,540 | A | 6/1998 | White |
| 2008/0055897 | A1 | 3/2008 | Yoshida et al. |
| 2008/0297780 | A1 | 12/2008 | Clasen |
| 2009/0279074 | A1 | 11/2009 | Seaver |
| 2010/0141937 | A1 | 6/2010 | Ryu |

FOREIGN PATENT DOCUMENTS

WO WO 2012136572 A1 * 10/2012

* cited by examiner

*Primary Examiner* — Anh Tran
(74) *Attorney, Agent, or Firm* — Luedeka Neely Group, P.C.; Rick Barnes

(57) ABSTRACT

An apparatus for illuminating a target surface, the apparatus having a plurality of LED arrays, where each of the arrays has a plurality of individually addressable LEDs, and where at least one of the arrays is disposed at an angle of between about forty-five degrees and about ninety degrees relative to the target surface, where all of the arrays supply light into a light pipe, the light pipe having interior walls made of a reflective material, where light exiting the light pipe illuminates the target surface, and a controller for adjusting an intensity of the individually addressable light sources.

20 Claims, 4 Drawing Sheets

LED SOLAR ILLUMINATOR

FIELD

This invention relates to the field of photovoltaic cells. More particularly, this invention relates to a light source for testing photovoltaic cells.

INTRODUCTION

One of the key areas of solar cell manufacturing is the final test and sort procedure. The purpose of final test and sort is to evaluate the current-voltage (I-V) characteristics of the solar cells, and to sort acceptable solar cells according to desired metrics, such as peak power, efficiency, fill factor, and so forth, and to detect and remove defective solar cells. The three basic components of an I-V tester are the solar illuminator, the contact probe unit, and the electrical tester unit.

The purpose of the solar illuminator is to provide light to the surface of the solar cell under test. The intensity and spectral characteristics of this light are preferably as close as possible to those of the sun under predetermined standard conditions. Solar illuminators usually operate in the spectral range of from about three hundred nanometers to about eleven hundred nanometers in pulse or continuous modes.

Current solar illuminators use gas-discharge xenon lamps, tungsten lamps, halogen lamps, or some combination of these lamps. Xenon-based illuminators tend to generate a substantial amount of heat, and require heavy direct current power sources and optical components such as infrared filters in order to operate. Another problem with xenon illuminators is their spatial and temporal non-uniformities. Using xenon illuminators, it is difficult to create a light flux that is homogeneous across the surface of the entire solar cell, which is typically about two hundred millimeters square. The spatial distribution of light intensity from these lamp-based illuminators is also not stable, in that it changes from pulse to pulse.

A light pulse in such illuminators usually requires some amount of time to reach its peak intensity value, typically between about ten microseconds and about one hundred microseconds. During this time, the junction temperature increases and the test of the solar cell is inaccurate. It is also difficult to modify the temporal profile of the pulse.

Finally, these illuminators have high operational and maintenance costs, mainly due to the short lifetime of the lamp (usually about one to two thousand hours) and the frequent downtime needed to replace them.

Light emitting diode (LED) illuminators have also been investigated. However, despite several advantages, LED illuminators have significant drawbacks. Most notably, the spatial and spectral uniformities of the light produced by such illuminators are poor and fail to meet the desired characteristics. In addition, LED illuminators require special test solar panels for periodic calibration and control of intensity, homogeneity, and spectral content.

There is a need, therefore, for an illuminator that reduces problems such as those described above, at least in part.

SUMMARY OF THE CLAIMS

The above and other needs are met by an apparatus for illuminating a target surface, the apparatus having a plurality of LED arrays, where each of the arrays has a plurality of individually addressable LEDs, and where at least one of the arrays is disposed at an angle of between about forty-five degrees and about ninety degrees relative to the target surface, where all of the arrays supply light into a light pipe, the light pipe having interior walls made of a reflective material, where light exiting the light pipe illuminates the target surface, and a controller for adjusting an intensity of the individually addressable light sources.

In various embodiments, each of the arrays is monochromatic. In some embodiments, each of the arrays is monochromatic, and all of the arrays exhibit a different peak wavelength. In some embodiments a monochromatic filter is associated with each of the arrays, where each array contributes only a monochromatic light to the light pipe. In other embodiments a monochromatic filter is associated with each of the arrays, where each array contributes only a different monochromatic light to the light pipe. Dichroic beam splitters disposed within the light pipe in some embodiments, for receiving the light from the arrays and directing the light down the light pipe toward the target surface. In some embodiments the light pipe has extensions disposed on the sides thereof, with the arrays disposed at distal ends of the extensions. In some embodiments the arrays are optically coupled to the light pipe and provide light thereto via fiber optic assemblies. In some embodiments the controller selectively and individually controls an intensity of the arrays, and thereby produces a light at the target surface having predetermined characteristics. Some embodiments include a reference system having a collector for sampling the light produced by the illuminator, the collector providing the light to a spectrometer for analyzing characteristics of the light.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
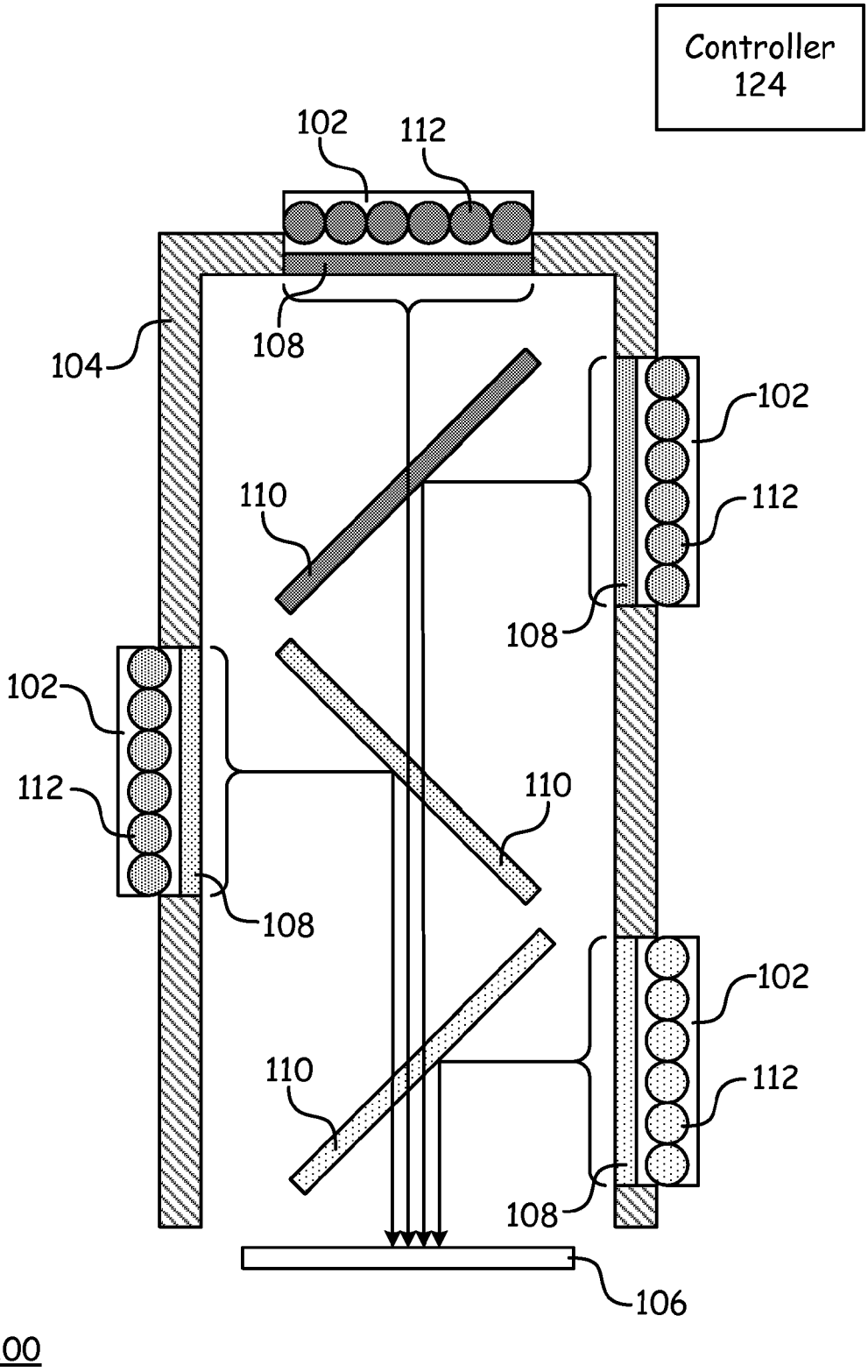
FIG. 1 depicts an LED illuminator according to a first embodiment of the present invention.

With reference now to FIG. 1, there is depicted a first embodiment of an illuminator 100 according to the present invention. In some embodiments, the illuminator 100 includes a light pipe 104, having interior walls are made of a highly reflective material, such as with a mirror surface. In some embodiments, the central axis of the light pipe 104 is disposed at about ninety degrees with respect to a test surface 106, such as the surface of a solar cell substrate. In some embodiments the size of the light pipe 104 in a horizontal plane is slightly larger than the size of the substrate to be tested, such as about two-hundred and twenty millimeters square.

At least one LED array 102 is attached to the light pipe 104, where the arrays 102 are disposed at angles of from about forty-five degrees to about ninety degrees with respect to the test surface 106. In some embodiments the illuminator 100 has from about three to about seven arrays 102. In one embodiment, one or more of the arrays 102 are formed of monochromatic LEDs 112. A combination of arrays 102 and laser diodes may be used to accurately simulate the radiation spectrum of the sun. In some embodiments, the electrical power driving each array 102 and laser diode is controlled independently. To achieve a specific mix of the light intensities from the arrays 102, the electrical current supplied to each array 102 is optimized according to the respective intensity of the corresponding spectral line in the sun radiation, such as by a controller 124.

In some embodiments, the light from one or more array 102 passes through a narrow band-pass filter 108, which passes a desired wavelength of the LEDs 112 behind the filter 108, but reflects other wavelengths, such as those emitted by other LEDs 112 In some embodiments a dichroic beam splitter 110 is used to direct the light emitted by the arrays 102 toward the test surface 106. In some embodiments, each dichroic beam splitter 110 is optimized for a predetermined wavelength or range of wavelengths, such as the wavelength emitted by an associated array 102. In this manner, the light that is emitted by several arrays 102 within the illuminator 100 is mixed in the light pipe 100 before reaching the test surface 106.

The illuminator 100 according to the present invention provides illumination to the test surface 106 with intensity uniformity, spatial uniformity, and spectral uniformity across the test surface 106 meeting all Class A specifications. The illuminator 100 of the present invention reduces thermal effects on the spatial uniformity and spectral content of the light. It is relatively easy to calibrate, maintain, and repair. Unlike prior art LED illuminators where a failure of one or more individual LEDs affects the spatial and spectral uniformities of the illumination, the illuminator 100 of the present invention compensates for such failure by adjusting the electrical drive current to the corresponding array 102.

Figure 2:
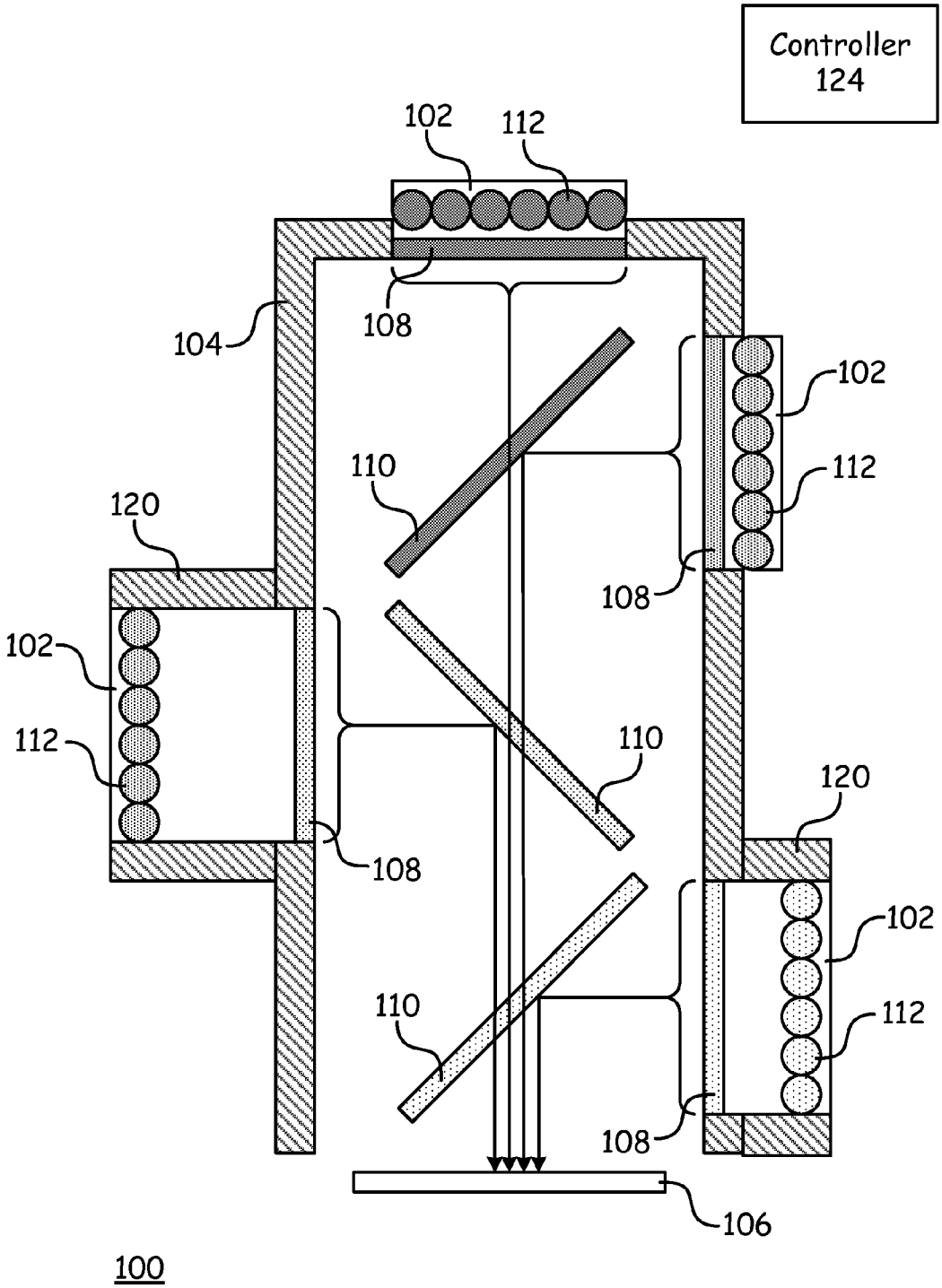
FIG. 2 depicts an LED illuminator according to a second embodiment of the present invention.
Figure 3:
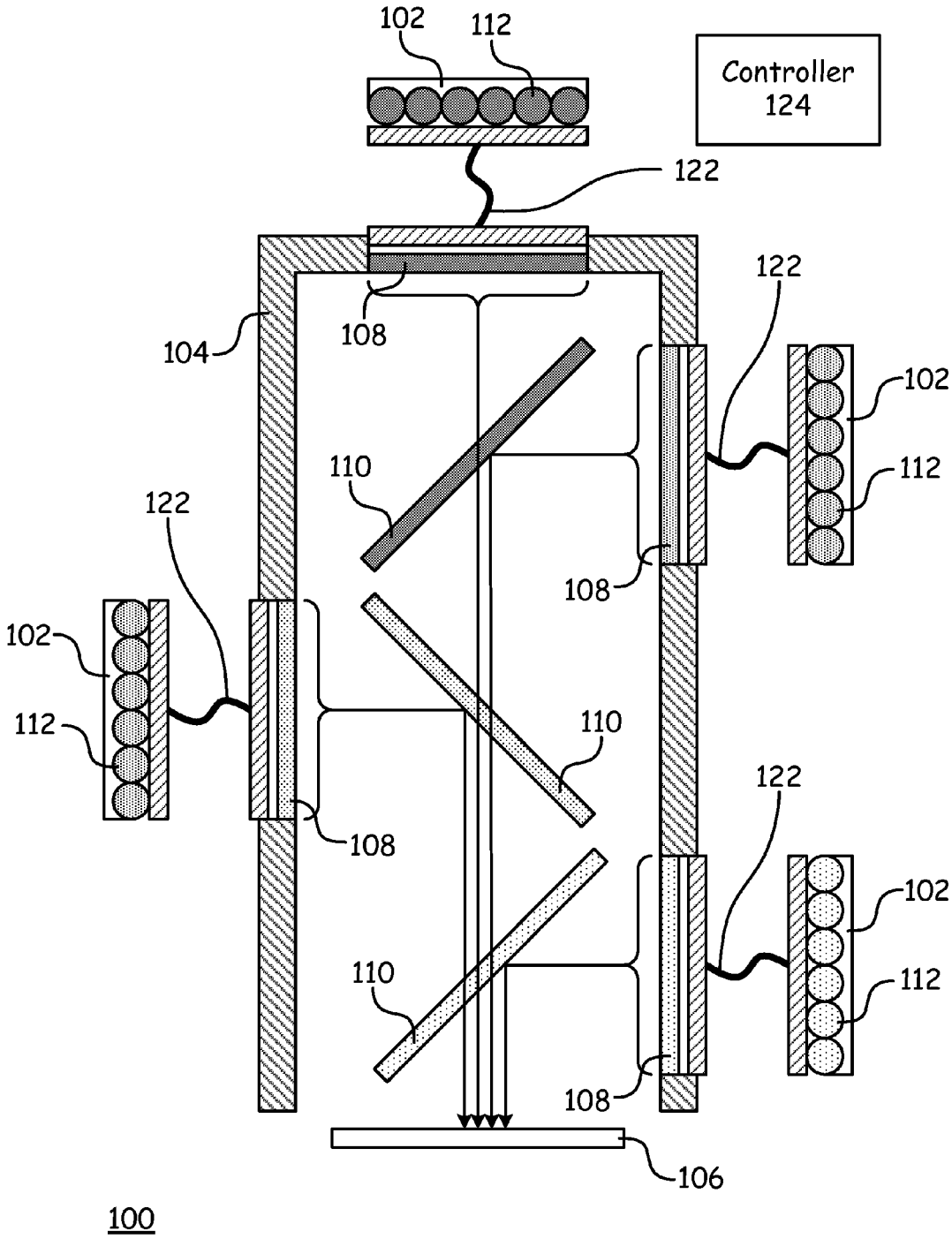
FIG. 3 depicts an LED illuminator according to a third embodiment of the present invention.

In some embodiments, as depicted in FIG. 2, the arrays are positioned down individual light pipe extensions 120, which extensions 120 have differing lengths in some embodiments. In other embodiments, the arrays 102 are disposed at remote locations, as depicted in FIG. 3. The light from the remote arrays 102 is connected to the light pipe 104 via optics and optical fibers 122. One or more of the remote arrays 102 is, in some embodiments, placed in a controlled temperature environment, resulting in less heating of the light pipe 104 and improved temporal performance of the illuminator 100.

In another embodiment, more than one of the illuminators 100 are placed adjacent one another in a group and used to illuminate a large test surface 106, such as thin film solar modules. The intensity and spectral content of the separate illuminators 100 in the group is independently adjusted, according to the position of the given illuminator 100 in the group.

Figure 4:
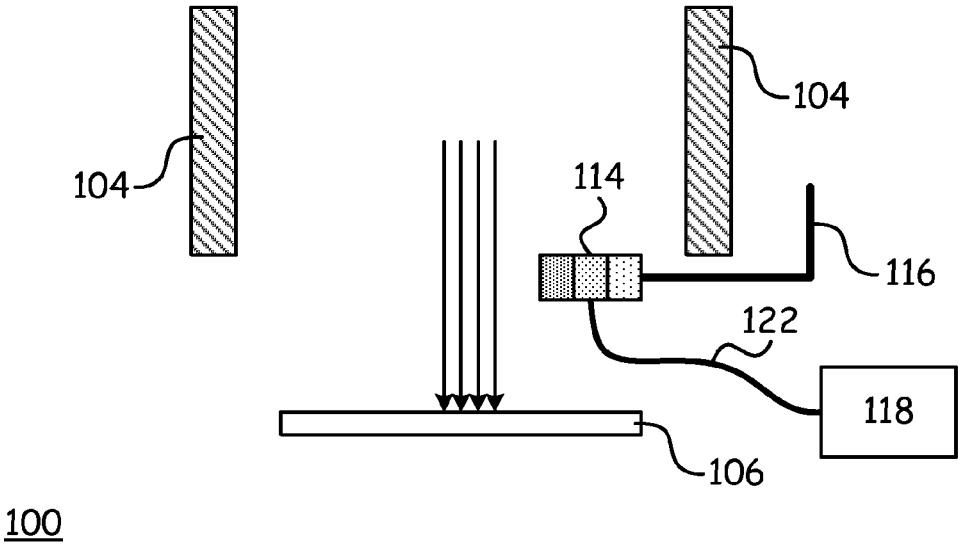
FIG. 4 depicts a reference detector according to a first embodiment of the present invention for self-calibration of an LED illuminator.
Figure 5:
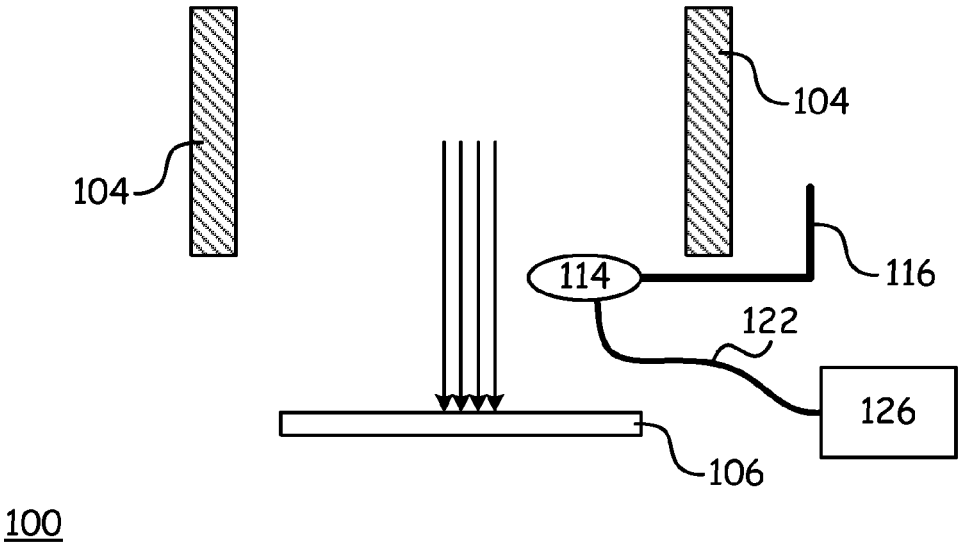
FIG. 5 depicts a reference detector according to a second embodiment of the present invention for self-calibration of an LED illuminator.

In various embodiments, the illuminator 100 includes a self-referencing system 114, as depicted in FIGS. 4-5. The referencing system 114 in the embodiment depicted in FIG. 4 includes photodiodes with color filters mounted on a retractable arm 116 and connected to a data acquisition device 118. The system 114 scans the light field at the exit of the illuminator 100, verifying its spatial uniformity and spectral content. In the embodiment depicted in FIG. 5, the system 114 includes a light collecting optical system connected to a spectrometer 126 via an optical fiber 122. In some embodiments, the system 114 provides feedback to the control board driving the electrical currents of the individual arrays 102. The light intensity of each individual array 102 contributes to the total light intensity, and the spectral content of the illuminator 100 can be adjusted according to the feedback from the system 114.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus for illuminating a target surface, the apparatus comprising:

a plurality of LED arrays, where each of the arrays comprises a plurality of individually addressable LEDs, and where at least one of the arrays is disposed at an angle of between about forty-five degrees and about ninety degrees relative to the target surface, where all of the arrays supply light into a light pipe, the light pipe having interior walls made of a reflective material, where light exiting the light pipe illuminates the target surface, and a controller for adjusting an intensity of the individually addressable light sources.

2. The apparatus of claim 1, wherein each of the arrays is monochromatic.

3. The apparatus of claim 1, wherein each of the arrays is monochromatic, and all of the arrays exhibit a different peak wavelength.

4. The apparatus of claim 1, further comprising a monochromatic filter associated with each of the arrays, where each array contributes only a monochromatic light to the light pipe.

5. The apparatus of claim 1, further comprising a monochromatic filter associated with each of the arrays, where each array contributes only a different monochromatic light to the light pipe.

6. The apparatus of claim 1, further comprising dichroic beam splitters disposed within the light pipe for receiving the light from the arrays and directing the light down the light pipe toward the target surface.

7. The apparatus of claim 1, wherein the light pipe has extensions disposed on sides thereof, with the arrays disposed at distal ends of the extensions.

8. The apparatus of claim 1, wherein the arrays are optically coupled to the light pipe and provide light thereto via fiber optic assemblies.

9. The apparatus of claim 1, the controller further for selectively and individually controlling an intensity of the arrays, and thereby producing a light at the target surface having predetermined characteristics.

10. The apparatus of claim 1, further comprising a reference system having a collector for sampling the light produced by the illuminator, the collector providing the light to a spectrometer for analyzing characteristics of the light.

11. An apparatus for illuminating a target surface, the apparatus comprising:

a plurality of LED arrays, where each of the arrays comprises a plurality of individually addressable LEDs, and where at least one of the arrays is disposed at an angle of between about forty-five degrees and about ninety degrees relative to the target surface, where all of the arrays supply light into a light pipe, wherein each of the arrays is monochromatic, and all of the arrays exhibit a different peak wavelength, the light pipe having interior walls made of a reflective material, where light exiting the light pipe illuminates the target surface, dichroic beam splitters disposed within the light pipe for receiving the light from the arrays and directing the light down the light pipe toward the target surface, and a controller for adjusting an intensity of the individually addressable light sources.

12. The apparatus of claim 11, wherein the light pipe has extensions disposed on sides thereof, with the arrays disposed at distal ends of the extensions.

13. The apparatus of claim 11, wherein the arrays are optically coupled to the light pipe and provide light thereto via fiber optic assemblies.

14. The apparatus of claim 11, the controller further for selectively and individually controlling an intensity of the arrays, and thereby producing a light at the target surface having predetermined characteristics.

15. The apparatus of claim 11, further comprising a reference system having a collector for sampling the light produced by the illuminator, the collector providing the light to a spectrometer for analyzing characteristics of the light.

16. An apparatus for illuminating a target surface, the apparatus comprising:

a plurality of LED arrays, where each of the arrays comprises a plurality of individually addressable LEDs, and where at least one of the arrays is disposed at an angle of between about forty-five degrees and about ninety degrees relative to the target surface, where all of the arrays supply light into a light pipe, the light pipe having interior walls made of a reflective material, where light exiting the light pipe illuminates the target surface, a collector for sampling the light produced by the illuminator, the collector providing the light to a spectrometer for analyzing characteristics of the light, and a controller for selectively and individually controlling an intensity of the arrays, and thereby producing a light at the target surface having predetermined characteristics.

17. The apparatus of claim 16, further comprising a monochromatic filter associated with each of the arrays, where each array contributes only a different monochromatic light to the light pipe.

18. The apparatus of claim 16, further comprising dichroic beam splitters disposed within the light pipe for receiving the light from the arrays and directing the light down the light pipe toward the target surface.

19. The apparatus of claim 16, wherein the light pipe has extensions disposed on sides thereof, with the arrays disposed at distal ends of the extensions.

20. The apparatus of claim 16, wherein the arrays are optically coupled to the light pipe and provide light thereto via fiber optic assemblies.

* * * * *